US005097541A

United States Patent [19]

Annand

[11] Patent Number: 5,097,541

[45] Date of Patent: Mar. 24, 1992

[54] SHOWER CURTAIN HOLDING DEVICE

[76] Inventor: Charles A. Annand, 4 Ridgewood Drive, Truro, Nova Scotia, Canada, B2N 5R4

[21] Appl. No.: 606,833

[22] Filed: Oct. 31, 1990

[30] Foreign Application Priority Data

May 17, 1990 [CA] Canada ..... 2017051

[51] Int. Cl.[5] ..... A47K 3/00

[52] U.S. Cl. ..... 4/558; 4/609

[58] Field of Search ..... 4/558, 607–609

[56] References Cited

U.S. PATENT DOCUMENTS

| | | | |
|---|---|---|---|
| 415,912 | 11/1889 | Kerr et al. . | |
| 1,416,270 | 5/1922 | Deming . | |
| 1,719,696 | 2/1931 | Alexander . | |
| 2,120,155 | 6/1938 | Shera . | |
| 2,173,993 | 9/1939 | Amdur . | |
| 2,188,163 | 1/1940 | Sherman | 156/20 |
| 2,219,075 | 10/1940 | Le Veau . | |
| 2,232,194 | 2/1941 | Zogby | 156/33 |
| 2,573,985 | 11/1951 | Porter . | |
| 2,654,106 | 5/1955 | Heubeck | 160/349 |
| 2,705,385 | 4/1955 | Markward . | |
| 2,774,974 | 12/1955 | Zaloga . | |
| 2,776,439 | 1/1957 | Rondinelli . | |
| 2,778,030 | 1/1957 | Goche . | |
| 2,878,487 | 3/1959 | Foote . | |
| 2,936,076 | 5/1960 | Harris | 211/113 |
| 3,104,014 | 9/1963 | Piette | 211/123 |
| 3,140,557 | 7/1964 | Albrycht . | |
| 3,382,507 | 5/1968 | Micheau . | |
| 3,418,665 | 12/1968 | Long . | |
| 3,872,520 | 3/1975 | Tyconik . | |
| 4,117,557 | 10/1978 | McPeak et al. . | |
| 4,229,842 | 10/1980 | Gilmore | 4/610 |
| 4,361,914 | 12/1982 | Oliver | 4/605 |
| 4,754,504 | 7/1988 | Cellini | 4/610 |
| 5,007,120 | 4/1991 | Annand | 4/609 |

FOREIGN PATENT DOCUMENTS 2514632 10/1981 France .

OTHER PUBLICATIONS

Slipex Shower Splash Control.

*Primary Examiner*—Charles E. Phillips
*Attorney, Agent, or Firm*—Lalos & Keegan

[57] ABSTRACT

A curtain holding device of the type for use in association with a shower curtain for holding the shower curtain against billowing into the shower area during use of the shower. The device is attachable to the shower curtain support rod together with the shower curtain so that a number of the devices may be drawn to spaced intervals along the intermediate portion of the support rod when the curtain is drawn from an open to a closed position. Unlike known shower curtain controlling devices, the device of the present invention includes a weighted member which provides a turning moment on an elongated curtain engaging member so as to force the member to pivot outwardly from the shower area not only to prevent the curtain from being drawn into the shower area but to hold an intermediate portion of the shower curtain outwardly from the shower area and thereby provide an enlarged shower area, particularly at an elbow height for the user of the shower. Because the device moves with the shower curtain to the open position, the weighted structure, which provides the turning force to the curtain engaging member when the curtain is closed, is connected to the curtain engaging member in a manner to permit it to be disengaged from its active position and to swing to a free hanging position so as not to cause the open curtain to be distorted.

17 Claims, 9 Drawing Sheets

SHOWER CURTAIN HOLDING DEVICE

BACKGROUND OF THE INVENTION

1. Field of the Invention

This invention relates to a curtain holding device, and more particularly, a device for use in association with a shower curtain for the purpose of holding the curtain outwardly of the shower area.

2. Description of the Prior Art

In conventional structures consisting of a bathtub and shower installation, a shower curtain rod is installed above the outer edge of the bathtub so that the shower curtain, which is normally suspended by a plurality of curtain rings for slidable movement along the curtain rod, hangs downwardly and its lower portion is contained within the outer wall of the tub so as to prevent water from spraying or running over the outer wall of the tub and thus wetting the area of the bathroom outside of the bathtub. The closeness of the shower curtain to the user of the shower due to the narrowness of the tub may provide an uncomfortable feeling, particularly at about the elbow height of the user standing within the tub and taking a shower. Various structures, including a bowed shaped curtain rod, such as that shown in U.S. Pat. No. 4,754,504, July 5, 1988, William F. Cellini, entitled "Shower Enlarger", have been designed to provide an enlarged shower area for an otherwise conventional bathtub and shower installation.

Also, a known phenomena which occurs during the use of a shower is for the shower curtain to be drawn inwardly from the bathtub wall and to billow against the shower user. This action is accompanied by a noticeable draft of air being drawn in to the shower area between the lower edge of the curtain and the inside of the bathtub wall. Various arrangements have been developed in an attempt to cause the lower edge of the shower curtain to adhere to the inside wall of the bathtub, including magnets carried in pockets along the lower edge of the shower curtain or open pockets which collect water so as to provide a weight at the bottom of the shower curtain such as in U.S. Pat. No. 2,173,993, Sept. 26, 1939, Leon H. Amdur, entitled "Shower Curtain"In U.S. Pat. No. 3,382,507, May 14, 1968, J. R. Micheau, entitled "Curtain Position Containing Means", there is shown elongated flexible members or braces which hang from the shower curtain support rod with the curtain and are provided with magnetic members at the bottom for urging the shower curtain against the inside of the outer side wall of the bathtub. In U.S. Pat. No. 2,120,155, June 7, 1938, J. W. Shera, entitled "Bath Curtain", there is shown a plurality of strings which are suspended from the shower curtain support rod and are provided with weights at their lower ends, the stings passing through straps affixed to the shower curtain so as to resist the inward billowing of the curtain during use of the shower. Generally, structures of the type described above have met with limited commercial success because of their having limited ability of preventing the flow of cold air into the shower area between the lower edge of the curtain and the tub and more particularly because they are not capable of preventing the mid-portion of the curtain from moving inwardly toward the shower area. If the structure is in the form a free hanging structure, it hangs straight down due to gravity and does not provide any positive horizontal force outward against the curtain, and accordingly, no extra elbow space is provided.

There are presently on the market devices which are attached to the shower curtain, particularly at the shower head end of the shower area, and are attached to the wall so as to hold the curtain for accomplishing a more complete seal between the curtain and the end wall, such as shown in U.S. Pat. No. 4,385,409, May 31, 1983, Robert H. File, entitled "Shower Curtain Bender". This type of structure must be of relatively complex design in order to permit the curtain to be folded tightly to one end of the shower rod when the curtain is opened. Moreover, this type of structure has substantially no effects on controlling the curtain against its undesirable functioning as described above. There is shown in U.S. Pat. No. 2,878,487, Mar. 24, 1959, L. Foote, entitled "Shower Curtain Adapter", a structure which is utilized at the shower head end of the curtain rod for performing the function of curling the curtain around the end of the shower area to prevent leakage and also for preventing the shower curtain from blowing in against the user. In this structure a wire type frame work is forced outwardly against the curtain by a lever which is hooked into an end eyelet of the curtain so that the weight of the curtain pivots the structure outwardly. Because of the light weight of most curtains utilized today, little positive force is provided for pivoting the structure outwardly, and the fact that it is utilized only at the end of the curtain, the structure is not capable of controlling the billowing of the curtain at the most important area, namely substantially midway between the length of the curtain and a significant distance downwardly from the curtain rod. Moreover, the structure shown in this arrangement, which is retained at the end of the curtain rod, affects the folding and hanging characteristics of the curtain when it is moved to the open position. French Patent Publication 2,514,632, Apr. 22, 1983, Yves Deveze, shows a structure including vertical members which are hooked at the upper end for placement over the shower curtain from within the shower area once the curtain is closed. The vertical members are shown as being joined by rigid cross members, which provide a weight for maintaining the device substantially vertical and resisting the curtain from being blown into the shower area. In this structure, the members which form the weight are affixed directly to the vertical members and therefore have limited effect on turning the members so as to swing outwardly from the shower area. The structure of this patent is designed to be hung on the support rod from within the shower area before a shower and then removed after a shower from within the shower area and before the curtain is opened.

U.S. Pat. No. 3,872,520, Mar. 25, 1975, William Tyconik, entitled "Curtain Support", shows a structure which is affixed to the curtain support rod and has a number of members extending therefrom for the purpose of holding the shower curtain back from the shower area. However, in order to provide the necessary force to maintain the curtain away from the shower area, it is necessary to drill a generally horizontal hole in the rail so as to receive a pin for locking the structure to the rail. The structure does not move automatically into place when the shower curtain is closed nor does it retract with the curtain when the curtain is opened. By removing the pin, the mounting portion of the structure allows the structure to rotate relative to the rail so as to hang freely from the rail.

SUMMARY OF THE INVENTION

According to the present invention there is provided a shower curtain holder for use with a shower curtain of the type suspended from a support rod by a plurality of curtain hooks slidable along the rod to enable the curtain to be extended from an open position on spreading of the hooks to a closed free hanging position for defining one side of the shower area. The device includes a rigid elongated curtain engaging member having attachment means for suspending it at an upper end thereof from the support rod so that it can experience free swinging movement away from the shower area. A weight member is connected to the curtain engaging member and is movable relative thereto between an inactive hanging position and a raised biasing position for applying a turning force to the curtain engaging member for forcing it to swing outwardly and hold the curtain away from the shower area.

Normally, one, two or three of the devices are utilized and are attached to the rod in relation to the curtain hooks so that the devices moved to spaced interval, preferably along a mid portion of the curtain rod, when the curtain is pulled to the closed position. Also, the devices move with the curtain to a stored or opened position at one end of the rod, and when the weight members are moved to their inactive position, they hang freely with the curtain engaging members so as not to distort the curtain when in the stored or open position.

The attachment means may include means defining an opening for receiving one or possibly two of the curtain hooks so as to hang freely from the hooks and to slide with the hooks as the curtain is opened or closed. In one embodiment in which the opening is adapted to receive two hooks, it has a length sufficient to contain an adjacent pair of the curtain hooks as they would be spaced in a normal spread condition with the shower curtain closed.

More specifically, the weight member includes an inner end having first connecting means for pivotally attaching the weight member to the curtain engaging member and an outer weighted end. The first connecting means of the weight member may connect the inner end thereof to the curtain engaging member at a location below the upper end of the curtain engaging member, and the weight member may have a second connecting means intermediate the ends thereof for detachably connecting the weight member to the curtain engaging member at a location on the curtain engaging member above the first connecting means so as to hold the weight member in its raised biasing position.

BRIEF DESCRIPTION OF THE DRAWINGS

In the accompanying drawings which show various embodiments of the invention by way of examples.

DESCRIPTION OF PREFERRED EMBODIMENT

Figure 1:
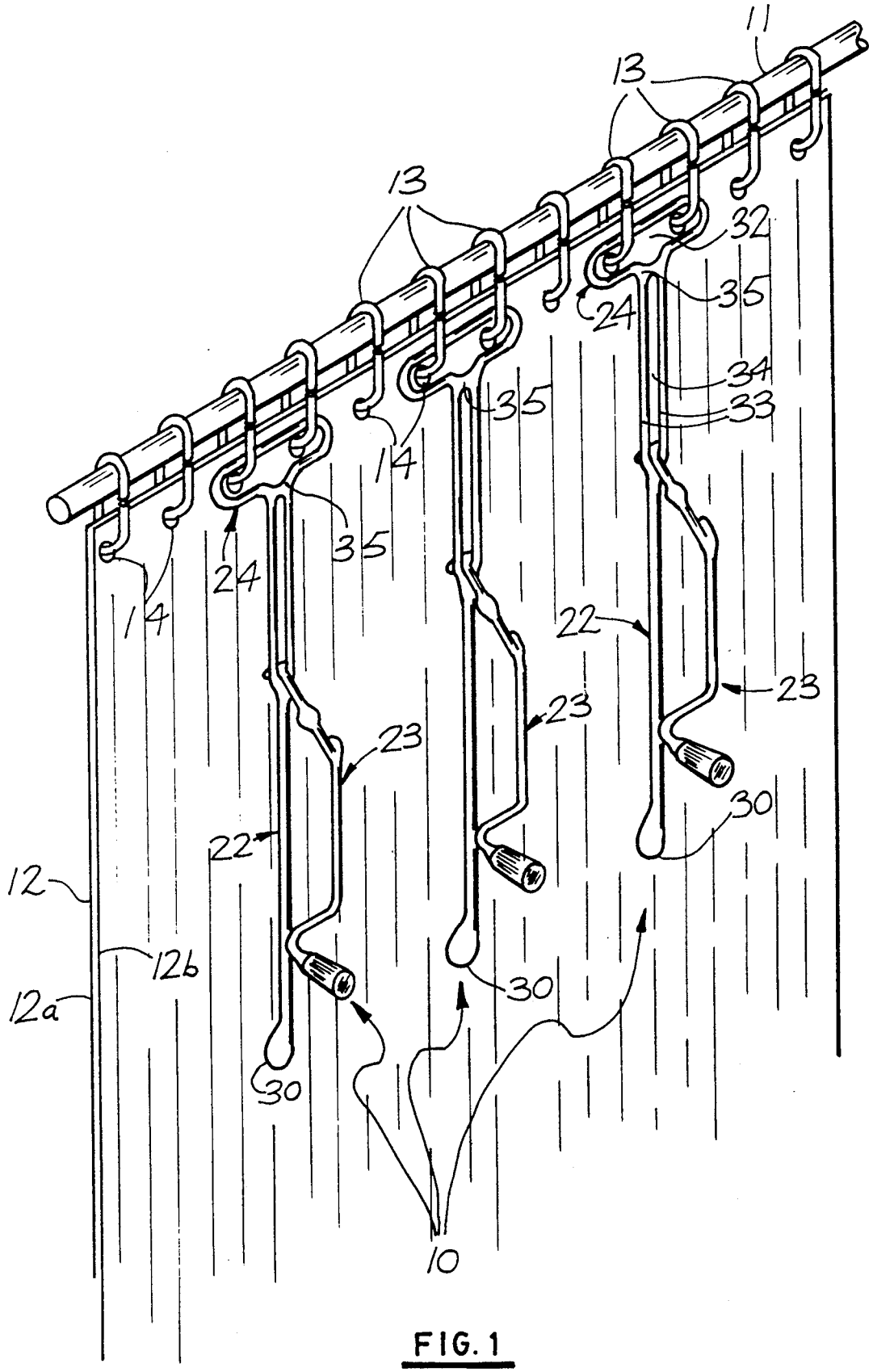
FIG. 1 is a perspective partial view of three of the devices of the present invention hanging in place with the shower curtain in a closed condition, but with the weight members of the devices in the inactive positions.

In FIGS. 1 to 7, the reference character 10 generally denotes the curtain holding device of the present invention. As may be readily apparent in FIG. 1, it is preferable to utilize a plurality of the devices 10, which are connected to a conventional shower curtain support rod 11 from which hangs a shower curtain 12. The shower curtain is supported by a plurality of rings or shower curtain hooks 13 which pass freely through a plurality of equally spaced apertures 14 disposed adjacent an upper edge of the shower curtain 12. The shower curtain 12 may consist of a single water impermeable sheet or it may include an outer decorative layer 12*a* provided with an inner liner 12*b*. The curtain 12 functions in the normal manner in that it hangs freely from the curtain hooks 13 which also encircle the support rod 11.

Figure 3:
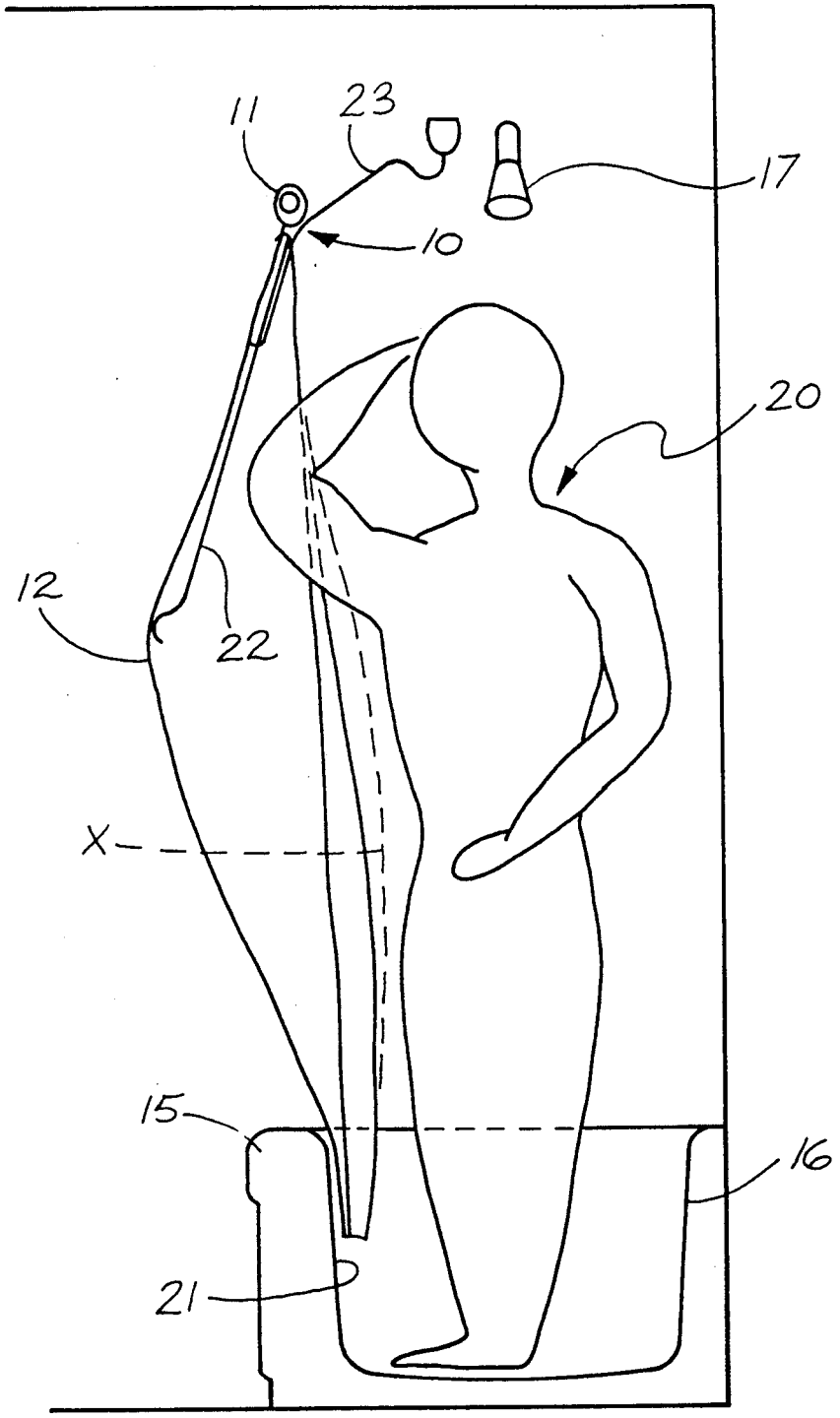
FIG. 3 is a cross-sectional view through the shower area and showing the shower curtain in a closed position with the shower curtain holding devices of the present invention in an active position.

The support rod 11 is mounted above the outer wall 15 of a bathtub 16. The bathtub-shower installation is shown as being provided with the normal shower head 17 directed into a shower area 20 (FIG. 3) which is defined by the walls surrounding the bathtub on three sides and the shower curtain which may be pulled to a closed position along the front or outer side of the bathtub. When not in use, the shower curtain is pulled to an open or stored position at one end of the bathtub 16. In the open position, the curtain hooks 13 are located close to each other, whereas when the curtain is pulled to the closed position, the hooks automatically space a distance approaching the distance between adjacent spaced pairs of the apertures 14 of the curtain. When pulled to the closed position, the curtain is usually adjusted so that the lower portion thereof is located within the inside surface 21 of the outer wall 15 of the bathtub (FIG. 3). As was described above, even when the shower curtain hangs in a substantially vertical closed position, the width of the shower area, which is, of course, determined mainly by the width of the bathtub is relatively narrow, and may prove uncomfortable, particularly at about elbow height. Moveover, if the curtain is not provided with a device to hold it out of the shower area, there is a tendency when the shower is operated under strong water pressure for the curtain to be drawn further into the shower area 20 to a position such as that designated in dashed lines as X in FIG. 3, and this is accompanied by a noticeable inflow of the air from the bathroom, which may be at a considerable lower temperature than that being experienced by the user of the shower in the shower area. The inflow occurs over the top edge of the outer wall 15 of the bathtub as the lower portion of the shower curtain separates from the inner surface 21 and moves into the shower area as well. In any event, the effect of the curtain being drawn into the shower area significantly reduces the width of the shower area, and may be sufficiently displaced to contact and cling to the user of the shower.

Figure 9:
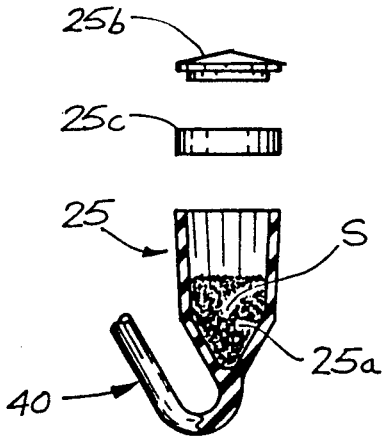
FIG. 9 is a cross sectional view through one embodiment of a weight portion of the curtain holding device.

The curtain holding device of the present invention includes a curtain engaging member 22 and a weighted member 23, which in an installed condition is attached to the curtain engaging member 22. The curtain engaging member is an elongated member, which may be relatively straight as is illustrated, for example, in FIG. 5. The curtain engaging member 22 is provided at its upper end with attachment means 24 which may attach it for pivotal movement directly to the curtain rod 11 for slidable movement therealong, or, as illustrated in the embodiments of the present invention, the attachment means 24 connects the curtain engaging member 22 to the curtain hooks 13. Both the curtain engaging member 22 and weighted member 23 may be molded from attractively coloured plastic and they are generally in the form of rod shaped members. The outer end of the weighted member has an enlarged weight portion 25 which may have molded therein a piece of metal in a cavity 25*a*. Alternatively, as shown in FIG. 9, other material, such as sand S, which is heavier than the plastic can be contained within the cavity to enhance the weight characteristics at the outer end of the weighted member. For example, the cavity 25*a* can be filled with a Barite sand which can then be adjusted in volume to act as a counterweight of variable force for use with heavier inside liners and outside decorative curtains which require a greater volume of Barite sand or alternatively with the single ply polyester lightweight shower curtains which would require a minimum amount of sand. From actual tests, the two layer curtains require 7 oz. of sand, whereas the one ply curtains require only about 3 oz. of sand. The counterweight portion which forms a cavity may have a wall thickness about 1/16 of an inch for containing the BARITE sand at variable levels. The cavity may be provided with a removable push-in cap 25*b* including a downwardly extending flange portion for reception within the surface of the inner wall of the cavity near its upper open end for retaining the sand in place. It is also preferable to provide a flexible foam disk which is larger than the inside diameter of the cavity in order for it to be an expansive fit within the cup, the insertion of this foam disk within the cavity before applying the cup maintains the sand compacted in the bottom of the cavity. Barite sand with a specific gravity of 4.48 is double the weight of silica sand which has a specific gravity of about 2.65. Thus, the use of Barite sand enables the cavity or counterweight chamber 25*a* to be of smaller dimensions and hence more appealing to the user. The ability of removing the cap so as to be able to insert a selective amount of sand, allows the weight characteristics to be varied to suit the type of shower curtain to be controlled.

The curtain engaging member 22 includes below the attachment means 24 a weighted member connection portion 26, and an extension portion 27 which extends downwardly from the weighted member connection portion 26 to a lower end 30. The lower end 30 may include an enlarged portion 31 which is the main curtain engaging portion of the member and is spaced below the support rod a sufficient distance to engage the curtain in an area which would be about the normal elbow height of a person standing within the shower area (FIG. 3). The attachment means 24 includes a transversely extending slot 32 formed by the rod-like member forming the curtain engaging member. The transverse slot has a length which is substantially equal to the normal spacing of the shower curtain hooks when the shower curtain is pulled to a closed position. Thus, it can be seen that the curtain engaging member hangs from the shower curtain hooks and as the shower curtain is pulled to the closed condition. The presence of the curtain engaging member does not hinder the curtain hooks from sliding to their normal spaced position so the curtain hangs in the usual manner. When the shower curtain is pulled back to the stored area, the hooks can bunch together in substantially the normal manner with the pair of hooks received in the transverse slot 32 of each of the curtain holding devices being able to move closer together within the transverse slot.

Formed integrally with the attachment means 24 is a pair of parallel side rods 33 which extend downwardly and form therebetween an elongated vertical slot 34. The parallel side rods converge at the bottom end of the vertical slot 34 and are formed integrally into extension portion 27. The upper end of the vertical slot 34 is separated from the transverse slot 32 by a short cross bar 35.

Figure 10:
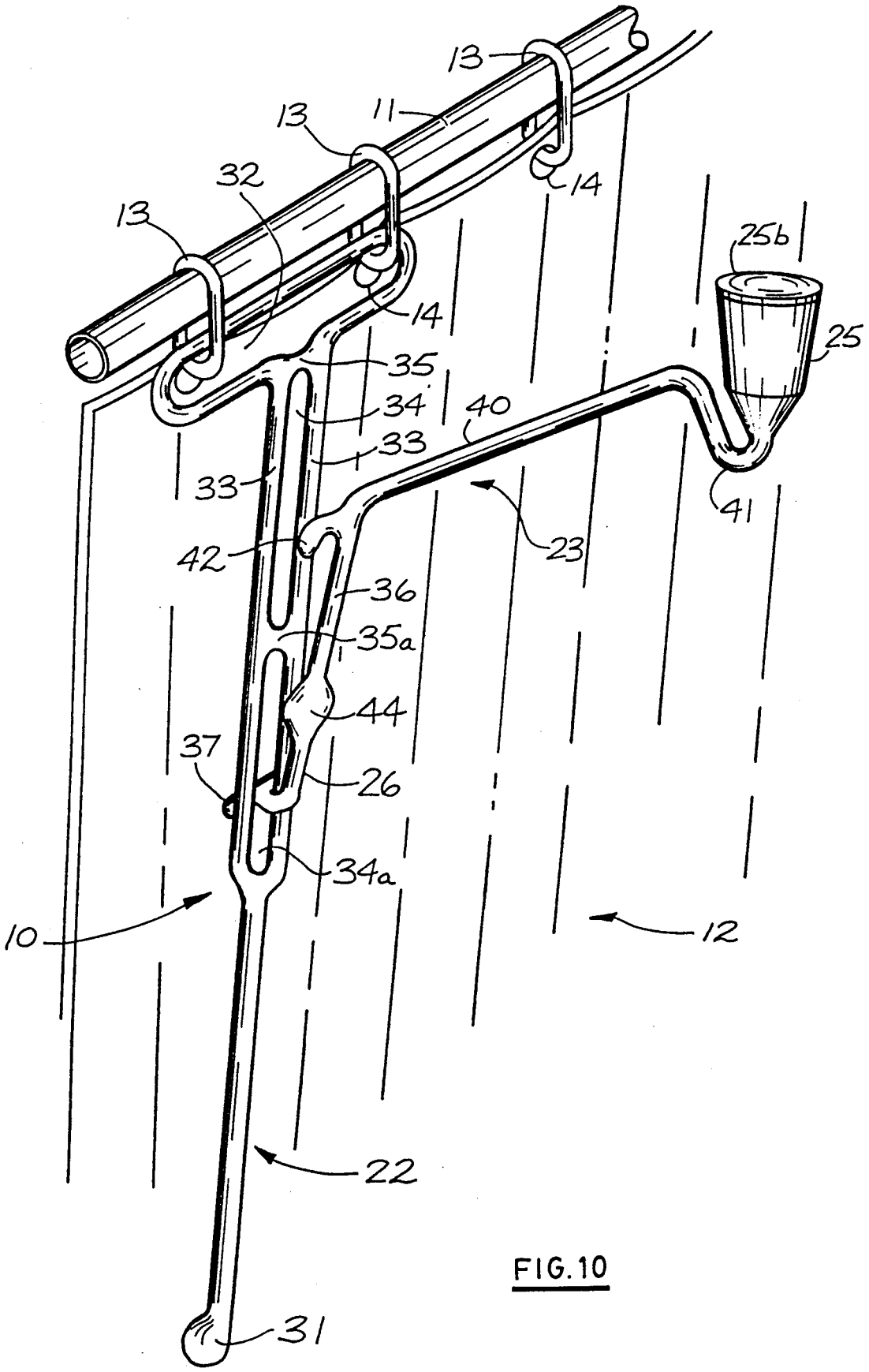
FIG. 10 is a perspective view similar to FIG. 6 but of a still further embodiment, and wherein the weight member is in a position being moved to the active position.

In the embodiment shown in FIG. 10, there is provided, as an alternative to the single slot 34 described above, a slot having a lower slot portion 34, which is longitudinally aligned with the upper slot portion 34, the slot portions being separated by a second or a lower cross bar 35*a*.

The weighted member 23 is attached, as indicated above, at its inner end to the curtain engaging member 23. The weighted member has an elongated stem portion 36 at its inner end, and this terminates in a head portion 37, which may be in a form of a short transverse rod. The stem portion 36, which extends through the vertical slot 34 is of slightly less width or diameter than the width of the vertical slot so that it may move through the slot and slide along the slot without being hindered. The head portion 37, however, is of greater width than the vertical slot so that the inner end of the weighted member cannot be pulled through the slot. The short transverse bar forming the head portion 37 may also be of slightly less diameter than the width of the vertical slot 34 so that the weighted member 23 may be turned sideways for insertion of the head portion through the vertical slot and then turned back to a position in a vertical plain common to the curtain engaging member so that the head portion or short transverse rod extends transversely behind the parallel side rods 33.

Figure 7:
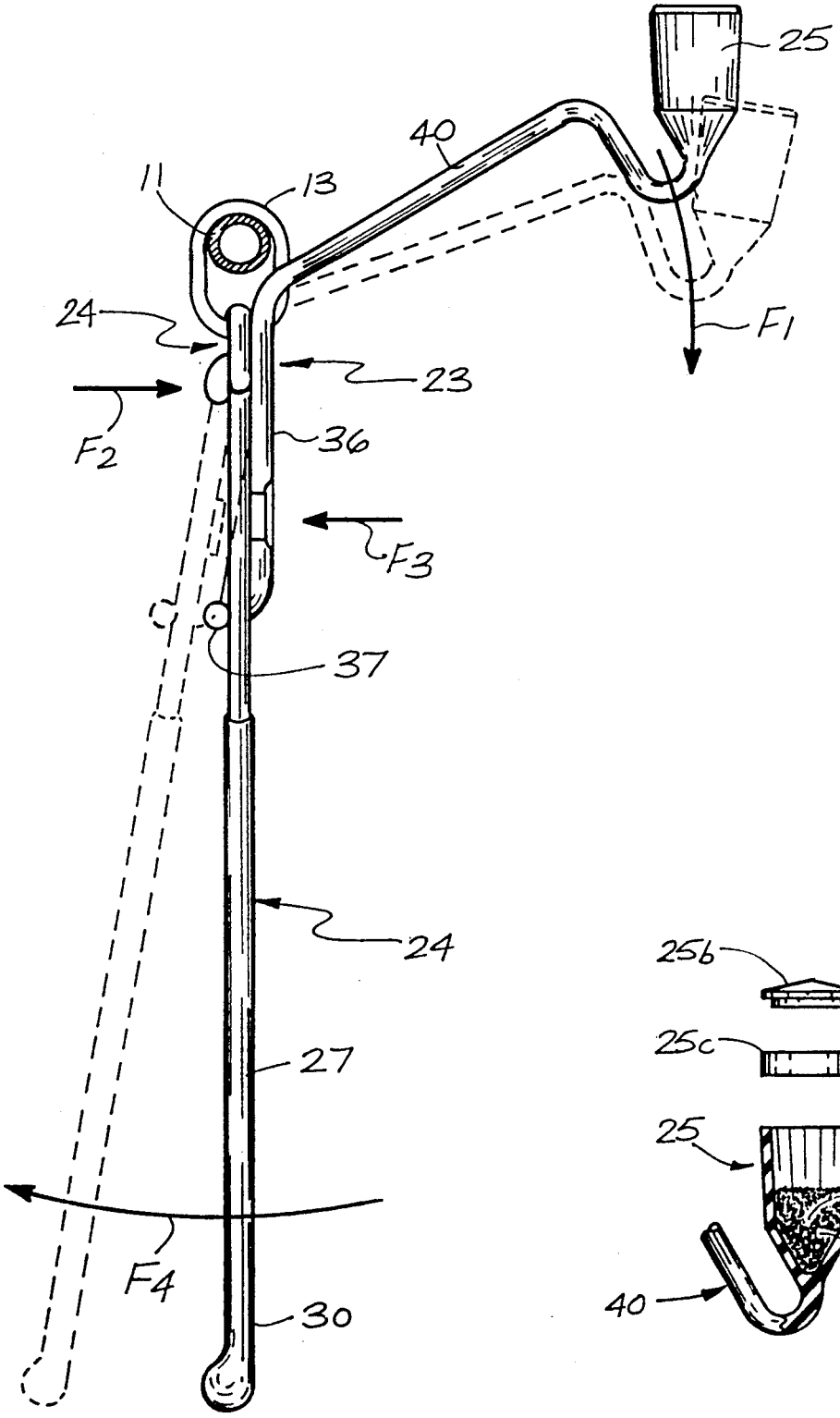
FIG. 7 is a side view of the shower curtain holding device as illustrated in FIG. 6.

The stem portion 36 at the inner end of the weighted member 23 is formed integrally at its outer end with an elongated intermediate portion 40 of the weighted member, the elongated intermediate portion 40 extending at an obtuse angle relative to the stem portion 36. The angle between the intermediate portion 40 and the stem portion 36 is selected so that when the weighted member is attached to the curtain engaging member in an activated position, and the stem portion 36 is positioned substantially parallel to and immediately adjacent the upper end of the curtain engaging member, the elongated intermediate portion 40 extends inwardly relative to the shower area but in an upward direction as is best illustrated in FIG. 7. At the opposite end of the intermediate portion 40, an outer end portion 41 is formed integrally with the stem portion and turns back in the same direction as the stem portion 36 but at a sharper angle. The outer end portion 41 is formed integrally with the weight portion 25 in a substantially U-shaped configuration.

Figure 5:
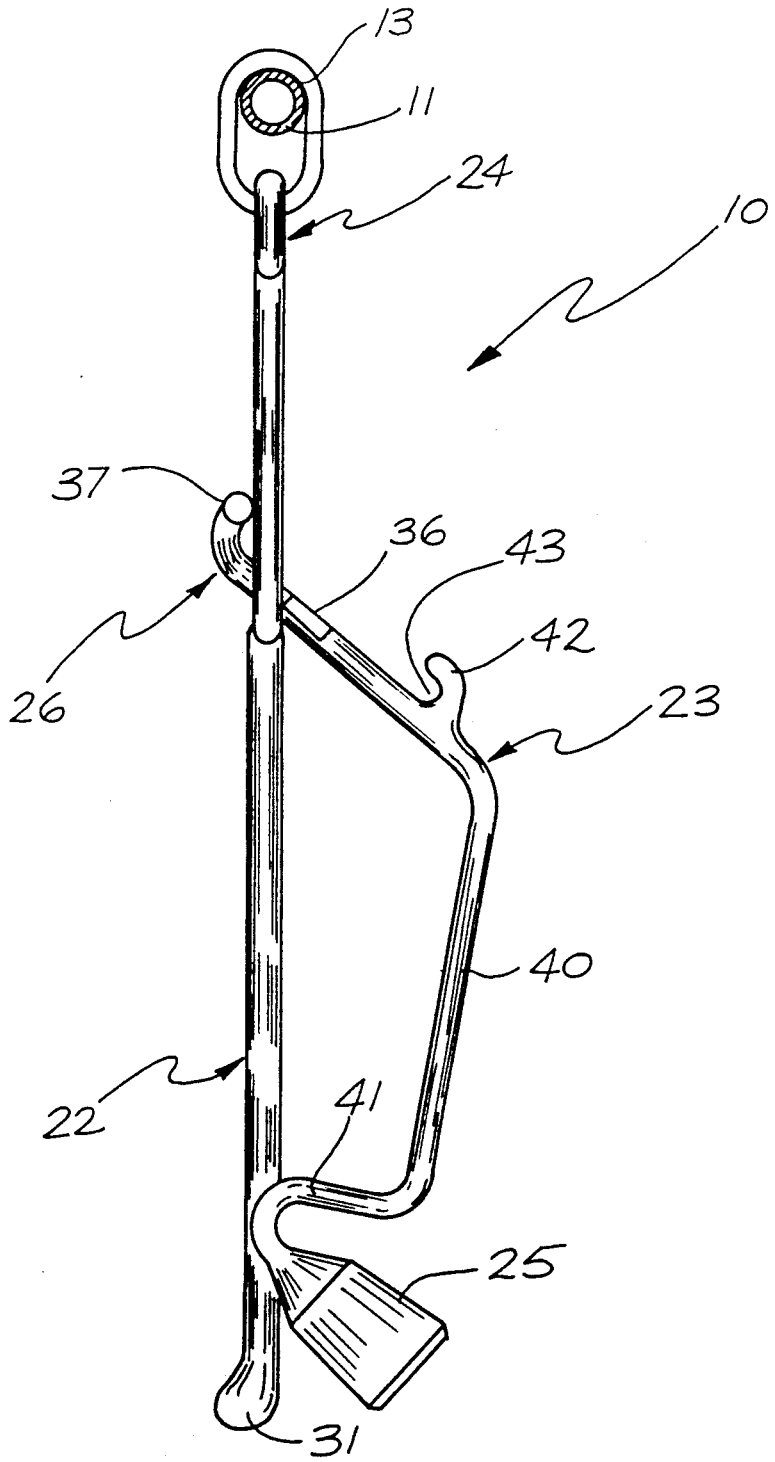
FIG. 5 is a side view of the shower curtain holding device as shown in FIG. 4.
Figure 6:
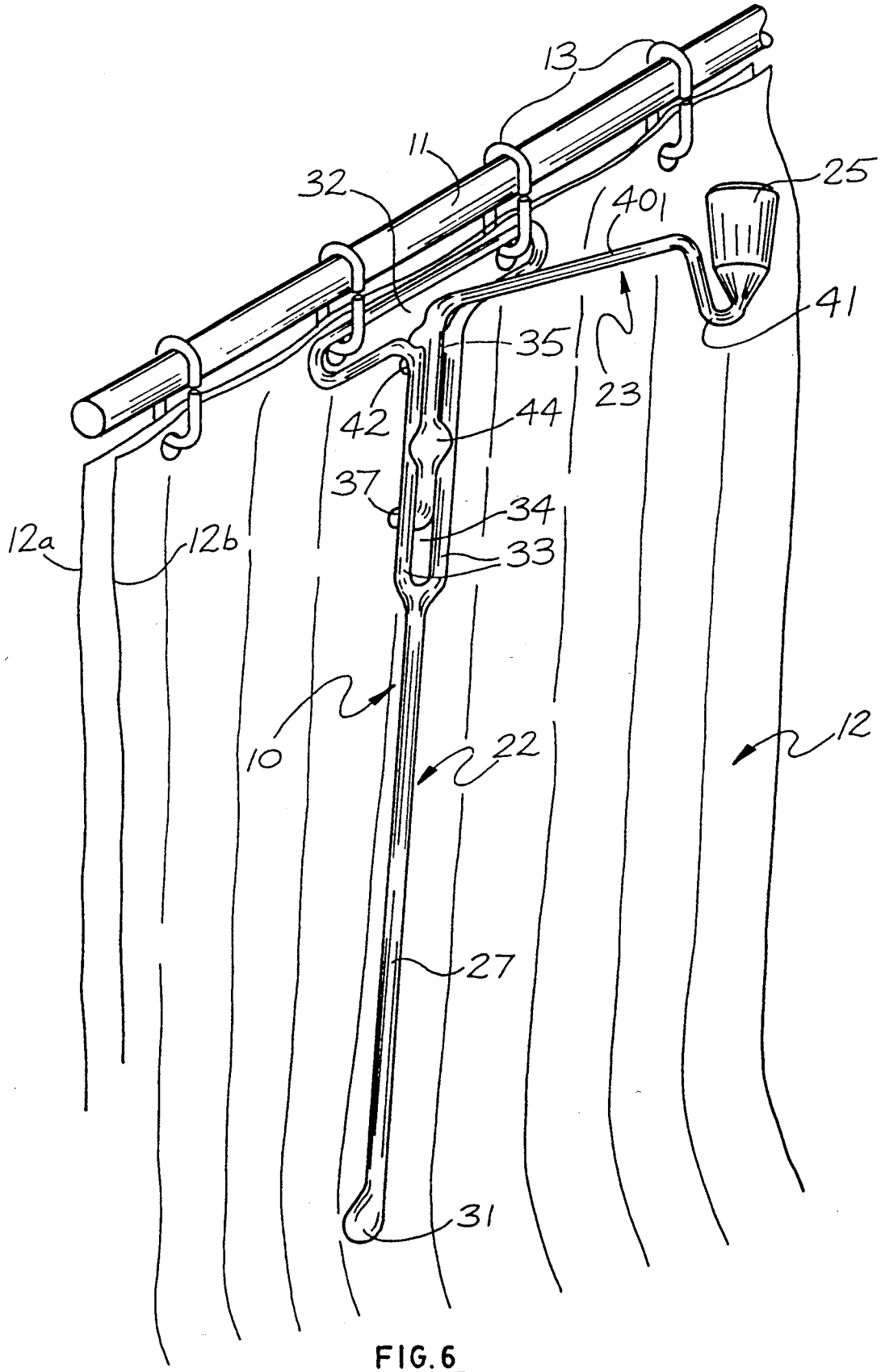
FIG. 6 is a perspective view similar to FIG. 4 and showing the shower curtain in a closed position with the shower curtain holding device of the present invention in an active position.

Near the junction of the outer end of the stem portion with the intermediate member 40, the stem portion 36 is provided with a hook portion which projects from the stem portion and is pointed toward the head portion end of the stem portion, thereby providing an open ended slot 43 (FIG. 5). Intermediate the hook portion 42 and the head portion 37 the stem portion has small projections on opposite sides thereof so as to provide an enlargement 44 (FIG. 6) which has greater width than the width of the vertical slot 34.

Figure 4:
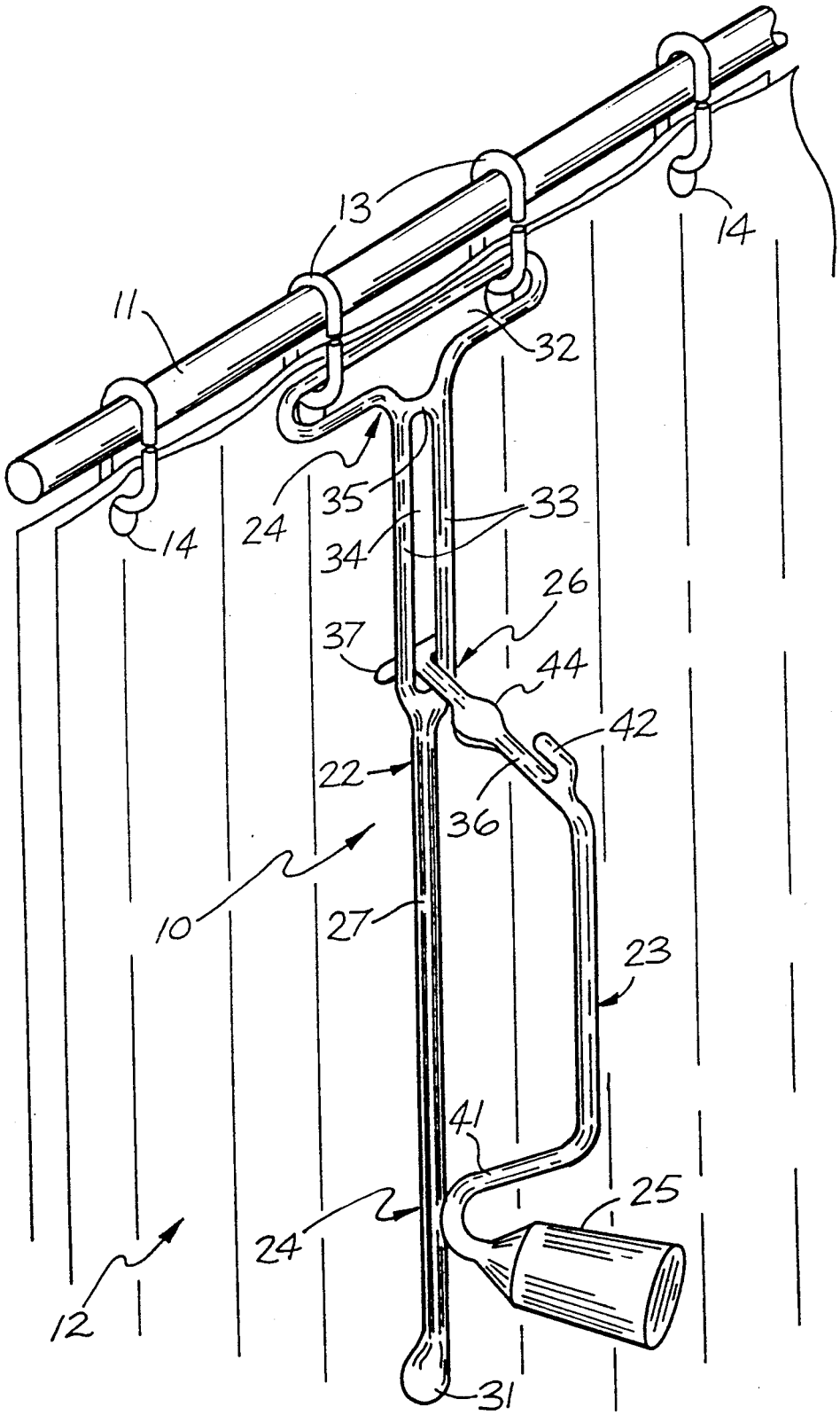
FIG. 4 is an enlarged perspective view of a single shower curtain holding device of the present invention with the weight member lowered to a free hanging inactive position.

The weighted member is normally maintained in an inactive or hanging position as shown, for example, in FIGS. 4 and 5. In this position, the stem 36 slides to the lower end of the vertical slot 34, but the inner end of the weighted member is prevented from withdrawing from the curtain engaging member by the head portion 37. In the inactive position, both the curtain engaging member and weighted member hang substantially vertically below the curtain hooks and the curtain support rod 11. Normally after one has taken a shower, the weighted member of each of the curtain holding devices are unhooked so that they can swing freely to the inactive or hanging position, and as the shower curtain is manipulated to its stored position at one end of the support rod 11, the freely hanging curtain engaging member 22 and weighted member 23 cause little distortion of the curtain from what would normally be a free hanging position.

When the curtain is pulled to the closed position, after one has entered the shower area in preparation for taking a shower, the curtain holding devices 10 assume the spaced position shown in FIG. 1. The weighted member 23 of each curtain holding device 10 is then grasped by the user and the connection between the inner end of the weighted member and the curtain engaging member allows the weighted member to be easily pivoted upwardly towards an active position. As the stem portion moves towards a position immediately adjacent the upper end of the curtain engaging member, as best seen in FIG. 5, the weighted member is shifted upwardly so that its inner end moves significantly up from the lower end of the vertical slot 34. As the weighted member is shifted upwardly, the outer end of the hook portion 32 is located above the cross bar 35 so that the weighted member can then be pushed slightly towards the curtain engaging member and then downwardly so that the cross bar 35 is captured in the short open ended slot 43 of the hook portion 42. The weighted member is thus held in its active position wherein its outer weighted end projects inwardly and upwardly a short distance over the shower area.

In the raised active position, the weighted member applies a force Fl downwardly as shown in FIG. 7 which tends to pull the connection between the hook portion and the cross bar 35 inwardly in the direction of the arrow shown F2, and the engagement of the enlargement 44 formed by the side projections with the parallel side rods 33 provides an outwardly turning force against the parallel side rods in the direction of the arrow F3. The overall effect, of course, is to provide a significant outwardly turning force as indicated by arrow F4 about the pivotal connection provided at the attached means 24. Therefore, the lower end of the curtain engaging means is forced outwardly of the shower curtain area so that the combination of the three curtain holding devices 10 provide a force sufficient to move a length of the curtain well out of the shower area, particularly at the elbow height of the user (FIG. 3). This outward force also draws the lower portion of the curtain against the inner surface 21 of the outer wall 15 of the bathtub.

In the embodiment shown in FIG. 10, the user has the option, of placing the hook portion 42 of the weight member over the cross bar 35 or over the cross bar 35*a*. While the height of the weighted member 23 is probably satisfactory for a normally placed support rod 11, when the hook portion 42 is placed over the lower cross bar 35*a*, an extra tall person may wish to provide more head room by placing the weight member 23 in a higher position by hooking the hook portion 42 over the cross bar 35. A short person would find hooking the hook portion 42 over the lower cross bar 35*a* more convenient.

Figure 8:
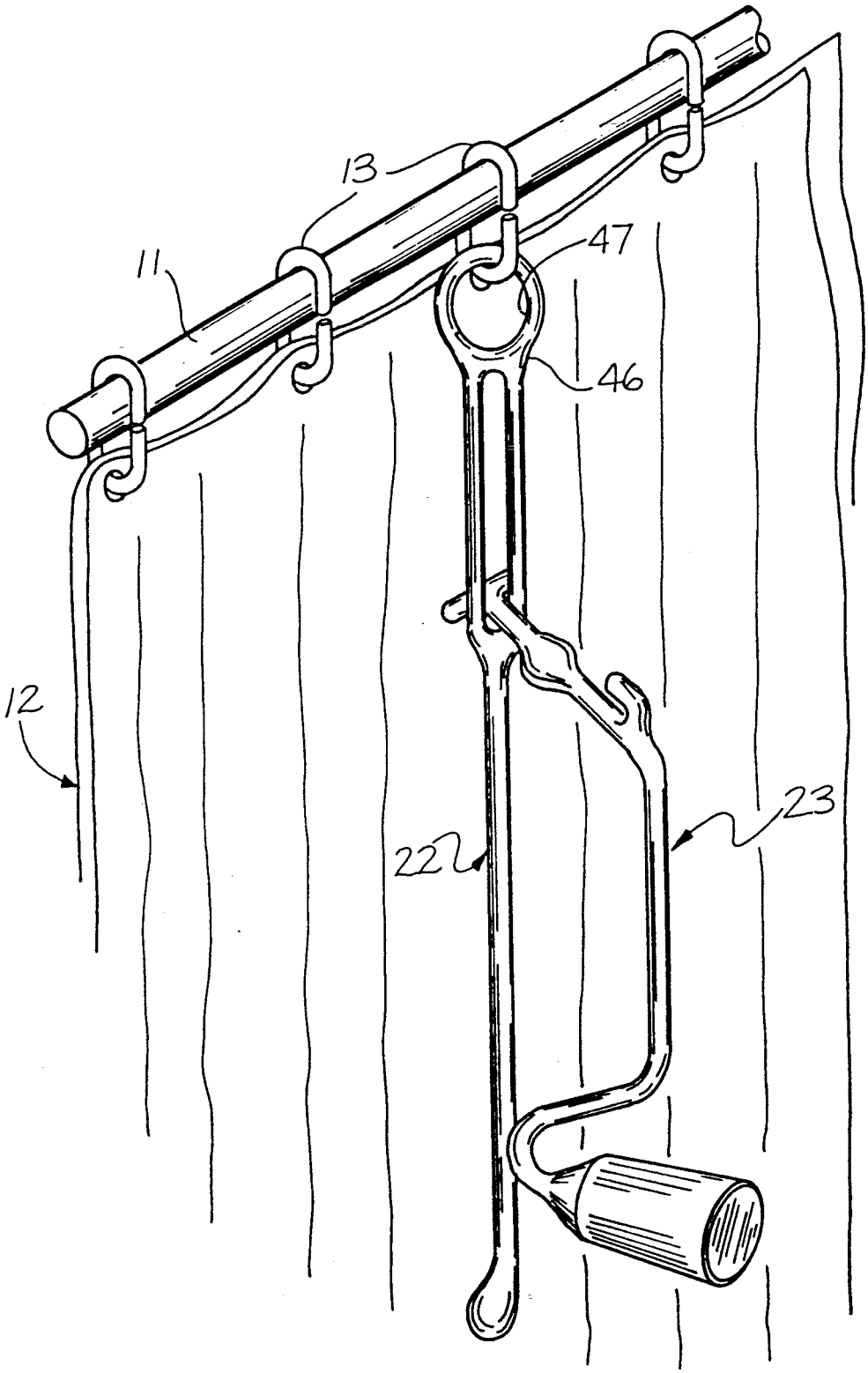
FIG. 8 is a view similar to FIG. 4 but showing a modified shower curtain holding device designed for an attachment to a single shower curtain hook.

The construction of the weight member of the embodiment shown in FIG. 8 may be exactly the same as that in the previously described embodiment. In the main, the structure of the curtain engaging member 20 is substantially the same except that rather than providing an elongated transverse slot for receiving two curtain hooks, the upper end of the curtain engaging member is provided with an enlarged section 46 defining an eye 47 which receives a single curtain hook. The embodiment shown in FIG. 8 functions in the same manner as that described above. However, with the smaller eye forming portion at the upper end of the embodiment of FIG. 8, there is slightly less interference with the normal actions of the shower curtain hooks as the shower curtain is moved between its open and closed position. This allows the device to be used on the curtains of stand-up shower stalls which have a narrow opening. One or two of the devices as shown in FIG. 8 may be used, and with the smaller eye, the access to the shower stall is not restricted by the device when the curtain is closed or opened by the user.

An advantage in forming the outer portion 41 of the weighted member together with the weight portion into a substantially U-configuration as illustrated in the drawings is that when in the activated position, the weighted member provides an upwardly open hook-like portion which can be utilized for suspending various shampoo containers, soaps, etc. which are frequently sold with means for suspending them from any element which may be located conveniently with respect to the shower area.

Figure 2:
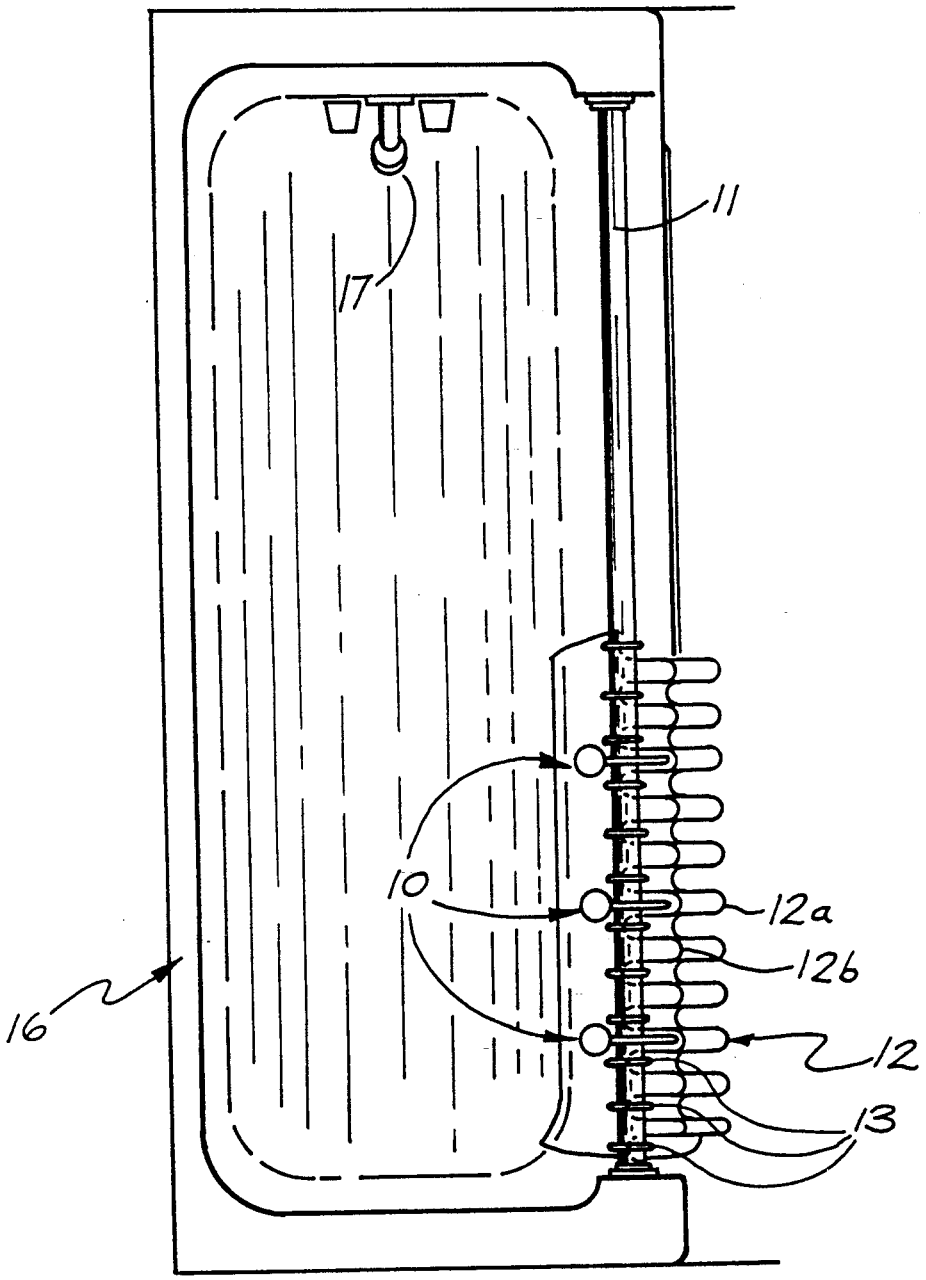
FIG. 2 is a top view of a conventional bathtub and shower installation and showing the shower curtain, together with the shower curtain holding devices in a stored or open position.

As previously described, the weighted members 23 can be readily moved to an inactive position when the shower has been completed and it is desired to open the shower curtain. Each weighted member 23 may be separately grasped by the user and raised slightly and then pulled towards the shower area so as to disengage the hook portion 32 from the cross bar 35. When released, the weighted member can then swing downwardly while the inner end of the stem slides to the lower end of the vertical slot 34. Thus, the curtain engaging members and weighted members hang together in a substantially vertical position. When the curtain is slid to its open position, the devices in the main hang between the folds of the shower curtain as is best illustrated in FIG. 2.

While a number of embodiments of the invention have been illustrated, other variations within the spirit of the invention as defined in the appending claims will be apparent to those skilled in the art.

What I claim is:

1. A curtain holder for use with a shower curtain of type suspended from a support rod by a plurality of curtain hooks slidable along said rod to enable the curtain to be extended from an open position on spreading of said hooks to a closed free hanging position defining one side of a shower area, said holder comprising:

a rigid elongated curtain engaging member having attachment means for suspending an upper end thereof from said support rod for free swinging movement away from said shower area, and a weight member connected to said curtain engaging member and movable relative thereto between an inactive position where said weight member hangs from said curtain engaging member to a raised biasing position where said weight member engages said elongated member for applying a turning force to said curtain engaging member causing said curtain engaging member to rotate about said rod and force said curtain outwardly of said shower area.

2. A curtain holder as defined in claim 1, wherein said weight member includes an inner end having first connecting means for pivotally connecting said weight member to said curtain engaging member, and an outer weighted end.

3. A curtain holder for use with a shower curtain of the type suspended from a support rod by a plurality of curtain hooks slidable along said rod to enable the curtain to be extended from an open position on spreading of said hooks to a closed free hanging position defining one side of a shower area, said holder comprising:

a rigid elongated curtain engaging member having attachment means for suspending an upper end thereof from said support rod for free swinging movement away from said shower area; and a weight member connected to said curtain engaging member and movable relative thereto between an inactive hanging position and a raised biasing position for applying a turning force to said curtain engaging member forcing said curtain engaging member to swing outwardly of said shower area, said weight member including an inner end having first connecting means for pivotally connecting said weight member to said curtain engaging member, and an outer weighted end, said first connecting means of said weight member connecting the inner end thereof to said curtain engaging member at a location below said upper end of said curtain engaging member, and said weight member having a second connecting means intermediate the ends thereof for detachably connecting said weight member to said curtain engaging member at a location on said curtain engaging member above said first connection means of said weight member and holding said weight member in said raised biasing position.

4. A curtain holder as defined in claim 3, wherein said curtain engaging member includes means defining an elongated vertical slot below said attachment means, and said first connecting means of said weight member includes a stem portion at the inner end thereof and projecting through said vertical slot, said stem portion terminating in a head portion of greater width that said slot for preventing withdrawal of said stem through said slot.

5. A curtain holder as defined in claim 4, wherein said stem portion of said weight member has a width less than that of the vertical slot for free sliding movement in said slot, and said curtain engaging member defines a lower end portion of said vertical slot, said head portion of said weight member engaging said end portion of said slot for holding said weight member in said inactive hanging position.

6. A curtain holder as defined in claim 4, wherein said curtain engaging member includes an end member defining an upper end of said vertical slot, and said stem portion includes a hook member spaced from said head portion for locking engagement with said end member to form said second connecting means holding said weight member in said raised biasing position.

7. A curtain holder as defined in claim 6, wherein said stem portion is provided with a widened section intermediate said head portion and said hook portion for engagement with said curtain engaging member on opposite sides of said vertical slot when said hook member locks said weight member in said raised biasing position.

8. A curtain holder as defined in claim 6, wherein said weight member includes an intermediate portion and an outer weighted end, said intermediate portion extending at an angle relative to said stem portion for locating said weighted end at a position extending upwardly into said shower area in said raised biasing position.

9. A curtain holder as defined in claim 8, wherein said the weighted outer end in formed integrally with said intermediate portion of said weight member by way of a bent portion forming an upwardly open hook in said raised biasing position.

10. A curtain holder as defined in claim 8, wherein said outer weighted end includes an enlarged portion defining a cavity closed by a removable cap, whereby said cavity can be filled with a selected amount of a weight material for affecting the magnitude of said turning force.

11. A curtain holder as defined in claim 10, wherein said weight material consists of a Barite sand.

12. A curtain holder for use with a shoulder curtain of the type suspended from a support rod by a plurality of curtain hooks slidable along said rod to enable the curtain to be extended from an open position on spreading of said hooks to a closed free hanging position defining one side of a shower area, said holder comprising:

a rigid elongated curtain engaging member having attachment means for suspending an upper end thereof from said support rod for free swinging movement away from said shower area, said attachment means of said curtain engaging member including means defining an opening for receiving one of said plurality of curtain hooks slidable on said support rod; and a weight member connected to said curtain engaging member and movable relative thereto between an inactive hanging position and a raised biasing position for applying a turning force to said curtain engaging member forcing said curtain engaging member to swing outwardly of said shower area.

13. A curtain holder for use with a shower curtain of the type suspended from a support rod by a plurality of curtain hooks slidable along said rod to enable the curtain to be extended from an open position on spreading of said hooks to a closed free hanging position defining one side of a shower area, said holder comprising:

a rigid elongated curtain engaging member having attachment means for suspending an upper end thereof from said support rod for free swinging movement away from said shower area, said attachment means of said curtain engaging member including an elongated opening extending transversely to said elongated curtain engaging member and being of a sufficient length to contain an adjacent pair of the curtain hooks in a normal spread condition; and a weight member connected to said curtain engaging member and movable relative thereto between an inactive hanging position and a raised biasing position for applying a turning force to said curtain engaging member forcing said curtain engaging member to swing outwardly of said shower area.

14. A curtain holder has defined in claim 13, wherein said curtain engaging member includes means defining an elongated vertical slot below the attachment means, wherein said first connecting means of said weight member includes a stem portion at the inner end thereof and projecting through the vertical slot, said stem portion terminating in a head portion of greater width than the slot for preventing withdrawal of the stem through the slot, and wherein said curtain engaging member has at least two longitudinally spaced means for receiving said second connection means of said weight member to thereby provide at least two locations at different heights for positioning said weight member in said raised position.

15. A curtain holder has defined in claim 14, wherein said curtain engaging member includes a transverse member defining a lower portion of said elongated opening, said transverse member defining an upper one of said connecting means of said curtain engaging member.

16. A curtain holder has defined in claim 15, wherein a second transverse member is positioned in said slot and provides a second lower connecting means of said curtain engaging member.

17. A curtain holder has defined in claim 16, wherein said slot extends to the first transverse member and is separated from said elongated opening by the first transverse member, said second transverse member dividing said slot into upper and lower portions.

* * * * *